US007494208B2

(12) United States Patent
Kwon et al.

(10) Patent No.: US 7,494,208 B2
(45) Date of Patent: Feb. 24, 2009

(54) INKJET PRINTHEAD HAVING A CANTILEVER ACTUATOR

(75) Inventors: Kye-si Kwon, Seoul (KR); Gee-young Sung, Daegu-si (KR); Seong-jin Kim, Seongnam-si (KR); Seung-jo Shin, Seoul (KR); Mi-jeong Song, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 326 days.

(21) Appl. No.: 11/260,260

(22) Filed: Oct. 28, 2005

(65) Prior Publication Data

US 2006/0092237 A1 May 4, 2006

(30) Foreign Application Priority Data

Nov. 2, 2004 (KR) ..... 10-2004-0088165

(51) Int. Cl.
*B41J 2/05* (2006.01)
*B41J 2/045* (2006.01)

(52) U.S. Cl. ..... 347/68; 347/54

(58) Field of Classification Search ..... 347/70–72
See application file for complete search history.

(56) References Cited

U.S. PATENT DOCUMENTS

| | | | |
|---|---|---|---|
| 4,564,851 A | 1/1986 | Nilsson et al. | |
| 5,739,832 A | 4/1998 | Heinzl et al. | |
| 6,003,971 A | 12/1999 | Hanks et al. | 347/43 |
| 6,264,849 B1 | 7/2001 | Silverbrook | |
| 6,270,202 B1 | 8/2001 | Namba et al. | |
| 6,431,689 B1 | 8/2002 | Schippers | |

FOREIGN PATENT DOCUMENTS

| | | |
|---|---|---|
| DE | 29 05 063 | 8/1980 |
| JP | 11-005305 | 1/1999 |
| JP | 2000246896 A * | 9/2000 |

OTHER PUBLICATIONS

Patent Abstracts of Japan, vol. 013, No. 565 (M-907), Dec. 14, 1989 & JP 01 235648 A (Seiko Epson Corp) Sep. 20, 1989.

* cited by examiner

*Primary Examiner*—Luu Matthew
*Assistant Examiner*—Lisa M Solomon
(74) *Attorney, Agent, or Firm*—Lee & Morse, P.C.

(57) ABSTRACT

An inkjet printhead having a cantilever actuator, the inkjet printhead including a plurality of ink chambers containing ink to be ejected; a manifold containing ink to be supplied to the plurality of ink chambers; a plurality of restrictors supplying ink to the plurality of ink chambers from the manifold; a plurality of nozzles ejecting ink from the plurality of ink chambers; and a plurality of cantilever actuators each installed in each of the plurality of ink chambers and having one fixed end and the other deflectable end, such that pressure for ejection of ink is applied due to the deflection of the other end of the cantilever actuator to the ink inside the ink chamber. The cantilever actuator may be made of a bimorph element, eject ink through the nozzle from the ink chamber, and also prevent backflow of ink from the ink chamber to the restrictor by virtue of the deflection of the other end thereof. Since the cantilever actuator can have a greater displacement and can prevent backflow of ink, the size of the ink chamber needed to eject ink droplets of uniform volume can be reduced, and thus the number of channels per inch (CPI) of the inkjet printhead can be increased.

21 Claims, 6 Drawing Sheets

INKJET PRINTHEAD HAVING A CANTILEVER ACTUATOR

BACKGROUND OF THE INVENTION

1. Field of the Invention

The present invention relates to an inkjet printhead. More particularly, the present invention relates to an inkjet printhead having a cantilever actuator that can reduce the volume of an ink chamber and increase the number of channels per inch (CPI).

2. Description of the Related Art

In general, inkjet printheads are devices for printing a predetermined color image by ejecting a small volume ink droplet at a desired position on a print medium, e.g., a sheet of paper or a fabric. Inkjet printheads are largely categorized into two types, depending on the ink ejection mechanism: thermal inkjet printheads and piezoelectric inkjet printheads.

The ink ejection mechanism in the thermal inkjet printheads, which rely on heated ink to provide a driving force, will now be briefly described. Generally, a thermal inkjet printhead relies on heating ink in an ink-filled chamber to generate bubbles, which in turn force ink out of the inkjet printhead. In greater detail, a current pulse flows through a heater formed of a resistance heating material to generate heat in the heater and in ink adjacent to the heater, such that the ink is rapidly heated. When the ink is boiled, bubbles are generated in the ink and expand, thereby applying pressure to the inside of the ink chamber. As a result, ink in the vicinity of a nozzle is ejected from the ink chamber as droplets exiting through the nozzle. Since such a thermal inkjet printhead generates bubbles by heating ink until the ink reaches a temperature of hundreds of degrees Celsius, a significant amount of energy is consumed and a high thermal stress is applied on the printhead. Further, a significant amount of time is required to cool the heated ink, limiting the ability to increase the driving frequency.

In contrast to thermal inkjet printheads, piezoelectric inkjet printheads eject ink using a piezoelectric element as a driving force. In such a printhead, the piezoelectric element deforms and this deformation is transferred through a wall of the ink chamber to apply pressure to the ink.

A conventional piezoelectric inkjet printhead is illustrated in FIGS. 1 and 2. Referring to FIGS. 1 and 2, a manifold 13 coupled to a restrictor 12 and an ink chamber 11, which together constitute an ink channel, may be formed on a channel plate 10. Of course, a typical inkjet printhead may have a number of ink channels thereon. A nozzle 22, arranged to correspond to the ink chamber 11, may be formed on a nozzle plate 20. A piezoelectric actuator 30 may be disposed on the channel plate 10.

The manifold 13 forms a path through which ink is introduced from an ink reservoir (not shown) and supplied to ink chamber 11. The restrictor 12 forms a path through which ink is introduced from the manifold 13 to the ink chamber 11. The ink chamber 11, in which ink to be ejected is contained, is arranged alongside the manifold 13. Where a number of ink channels are provided, ink chambers may be arranged along both sides of the manifold 13. The volume of the ink chamber 11 is changed by driving the piezoelectric actuator 30 to produce a pressure change for ink ejection and/or introduction. To this end, a portion of the ink chamber, e.g., a portion of the channel plate 10 forming an upper wall, i.e., a ceiling wall, of the ink chamber 11, may act as a vibration plate 14 that is deformed by the piezoelectric actuator 30.

In the operation of the conventional piezoelectric inkjet printhead constructed as described above, when the vibration plate 14 is deformed by the driving of the piezoelectric actuator 30, the volume of the ink chamber 11 is reduced. Accordingly, an internal pressure of the ink chamber 11 is changed such that ink contained in the ink chamber 11 is outwardly ejected through the nozzle 22. Subsequently, if the vibration plate 14 returns to its original state, due to the driving of the piezoelectric actuator 30, the volume of the ink chamber 11 is increased, the internal pressure of the ink chamber 11 is accordingly changed and ink is introduced from the manifold 13 through the restrictor 12 to the ink chamber 11.

When an image is printed using the conventional piezoelectric inkjet printhead having the above structure, the resolution of the image is directly affected by the number of nozzles per inch. Herein, a number of channels per inch (CPI) generally indicates the number of nozzles per inch, and a number of dots per inch (DPI) is generally a measure of the resolution of the printed image.

In the conventional piezoelectric inkjet printhead illustrated in FIGS. 1 and 2, the volume of ink droplets ejected through the nozzle 22 is greatly affected by the displacement of the vibration plate 14. That is, a large displacement of the vibration plate 14 results in large ink droplets, and a lesser displacement of the vibration plate 14 results in smaller ink droplets. The displacement of the vibration plate 14 is dependent on the area of the vibration plate 14, and the area of the vibration plate 14 is dependent on the volume of the ink chamber 11. That is, since the vibration plate 14 may constitute an upper wall of the ink chamber 11, the dimensions of the vibration plate 14 correlate directly with an area of the upper wall of the ink chamber 11 and, accordingly, with the volume of the ink chamber 11.

In the conventional inkjet printhead, when the vibration plate 14 is deformed by driving the piezoelectric actuator 30, ink is ejected through the nozzle 22 and also flows back toward the manifold 13 via the restrictor 12. Accordingly, to eject ink droplets of a predetermined volume, the displacement of the vibration plate 14 needs to take into account the amount of ink backflow. Accordingly, the area of the vibration plate 14, and thus and the area of the ink chamber 11, may need to be increased in order to maintain the desired volume of ink ejected from the nozzle 22.

Generally, the number of CPI of the piezoelectric inkjet printhead is in inverse proportion to a distance $D_N$ between adjacent nozzles 22. Thus, to increase the number of CPI of the printhead, the distance $D_N$ between the adjacent nozzles 22 should be reduced. However, the conventional piezoelectric inkjet printhead having the structure described above has limitations in reducing the distance $D_N$ between the adjacent nozzles 22 for the previously mentioned reasons. In particular, reducing the distance $D_N$ may affect the area of the ink chamber 11 and the area of the vibration plate 14, thereby reducing the volume of ink that can be ejected.

Another aspect of the conventional inkjet printhead is that it may be employed to print an image on a sheet of paper or other print medium by causing it to reciprocate in a direction orthogonal to a feed direction of the sheet, i.e., where the sheet is fed lengthwise into the printer, the inkjet printhead may be reciprocated in a width direction of the sheet.

Accordingly, the need to reciprocate the conventional inkjet printhead may result in a slow printing speed.

Inkjet printheads having a length equal to the width of a sheet of paper have been developed to increase printing speed. Such a printhead may have a plurality of nozzles that are arrayed in a width direction of the sheet of paper to print an image on the sheet at high speed without reciprocation in the width direction of the sheet. An inkjet printhead having this structure is generally called a page-wide inkjet printhead.

However, in order to print an image with sufficiently high resolution, without any reciprocation in a width direction of the sheet of paper, the number of CPI needs to be equal to the number of DPI of an image. Since the conventional piezoelectric inkjet printhead has structural limitations in increasing the number of CPI, as described above, it may be difficult to have the number of CPI equal the number of DPI of the image. Accordingly, to satisfy the demands for images with high resolution while maintaining or improving print speed, further efforts are needed to increase the number of CPI of a printhead.

SUMMARY OF THE INVENTION

The present invention is therefore directed to an inkjet printhead having a cantilever actuator, which substantially overcomes one or more of the problems due to the limitations and disadvantages of the related art.

It is therefore a feature of an embodiment of the present invention to provide an inkjet printhead having a cantilever actuator, which can increase the number of channels per inch (CPI).

It is therefore another feature of an embodiment of the present invention to provide an inkjet printhead having a cantilever actuator, which can reduce the volume of an ink chamber.

It is therefore yet another feature of an embodiment of the present invention to provide an inkjet printhead having a cantilever actuator with a large displacement.

It is still another feature of an embodiment of the present invention to provide an inkjet printhead having a cantilever actuator that can prevent ink backflow.

At least one of the above and other features and advantages of the present invention may be realized by providing an inkjet printhead including a manifold coupled to a plurality of ink channels, each ink channel including a restrictor, an ink chamber and a nozzle, wherein each ink chamber may include a cantilever actuator having a fixed end and a deflectable end, the cantilever actuator disposed in the ink chamber such that the deflectable end can deflect to eject ink via the nozzle.

The cantilever actuator may be a piezoelectric actuator that moves the deflectable end in a first direction with respect to the fixed end upon application of a voltage having a first polarity. The cantilever actuator may be a bimorph piezoelectric actuator that moves the deflectable end in a first direction with respect to the fixed end upon application of a voltage having a first polarity and moves the deflectable end in a second direction, opposite the first direction, upon application of a second voltage having a polarity opposite the first polarity. The cantilever actuator may be disposed in the ink chamber such that the deflectable end can deflect to eject ink via the nozzle and restrict a backflow of ink through the ink channel. The cantilever actuator may be disposed relative to the restrictor such that the deflectable end can restrict a backflow of ink from the ink chamber to the restrictor.

The cantilever actuator may have an inactive state and a first active state, the cantilever actuator may be disposed to regulate a cross-section of an ink flow path between the ink chamber and the restrictor, the ink flow path may have a first cross-section when the cantilever actuator is in the inactive state, and the ink flow path may have a second cross-section that is smaller than the first cross-section when the cantilever actuator is in the first active state. The cantilever actuator may further have a second active state, and the ink flow path may have a third cross-section that is larger than the first cross-section when the cantilever actuator is in the second active state.

The fixed end of the cantilever actuator may be inserted between two channel plates, one of the two channel plates may have the ink chamber and the restrictor formed therein, and another of the two channel plates may form a ceiling wall of the ink chamber and the restrictor. The cantilever actuator may be disposed adjacent to the ceiling wall of the ink chamber, such that the deflectable end of the cantilever actuator may be deflected, relative to the fixed end, only in a direction that is away from the ceiling wall. The restrictor may have a first thickness corresponding to a thickness of the one channel plate, the deflectable end may deflect a second distance upon application of a voltage, and the second distance may be greater than the first distance.

The fixed end of the cantilever actuator is inserted between two channel plates, one of the two channel plates may have the ink chamber formed therein, and another of the two channel plates may have the restrictor formed therein. The cantilever actuator may be spaced a predetermined distance from an upper wall of the ink chamber, such that the deflectable end of the cantilever actuator can move in a first direction with respect to the fixed end upon application of a voltage having a first polarity and move in a second direction, opposite the first direction, upon application of a second voltage having a polarity opposite the first polarity. The ink chamber may be formed in the one channel plate such that the ink chamber has a dimension corresponding to a thickness of the one channel plate, and the deflectable end may move into the ink chamber when it moves in the first direction. The deflectable end may move away from the restrictor when it moves in the first direction.

The cantilever actuator may be a bimorph element and may include a metal plate sandwiched between piezoceramic plates that are polarized in opposite directions. The cantilever actuator may have a shape corresponding to the shape of the ink chamber. A width of the cantilever actuator may be less than a corresponding width of the ink chamber. A length of a cantilevered portion of the cantilever actuator may be less than a corresponding length of the ink chamber. The inkjet printhead may have a length corresponding to a width of a print medium and may further include a plurality of nozzles arrayed in a longitudinal direction of the inkjet printhead.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
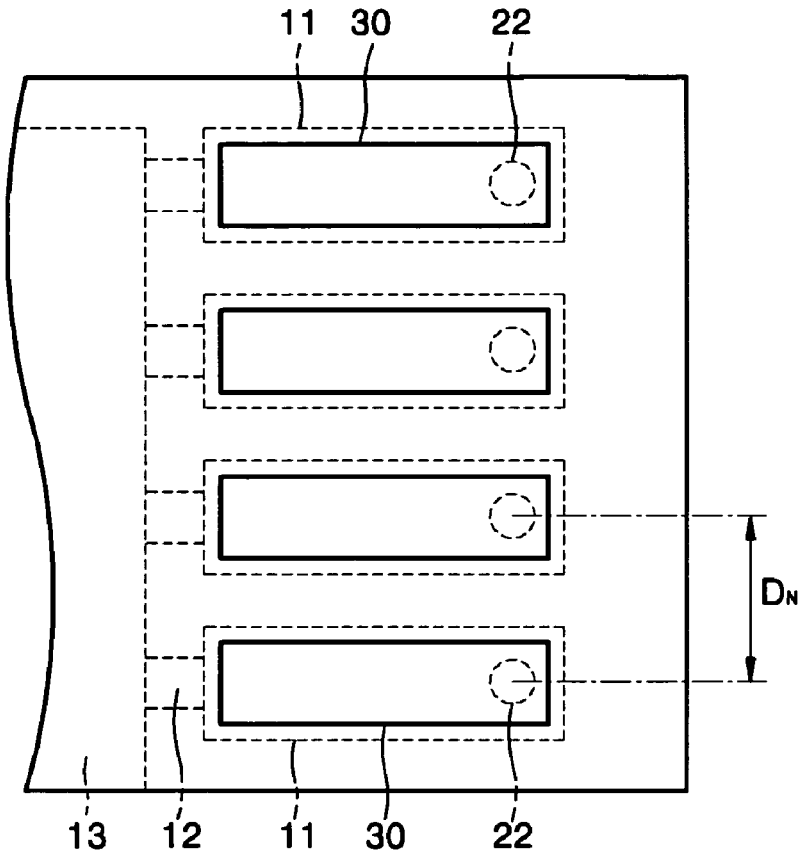
FIG. 1 (PRIOR ART)
FIG. 1 illustrates a plan view of a conventional piezoelectric inkjet printhead.
Figure 2:
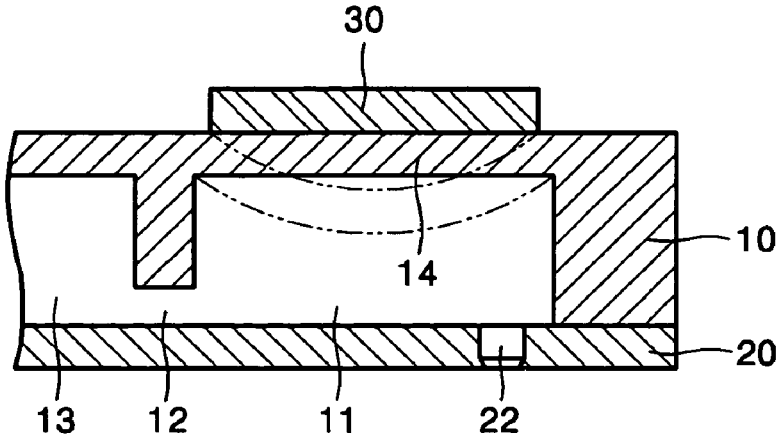
FIG. 2 (PRIOR ART)
FIG. 2 illustrates a sectional view of the conventional piezoelectric inkjet printhead illustrated in FIG. 1, taken along a longitudinal direction of an ink chamber.

Korean Patent Application No. 10-2004-0088165, filed on Nov. 2, 2004, in the Korean Intellectual Property Office, and entitled: "Inkjet Printhead Having Cantilever Actuator," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

An inkjet printhead according to the present invention may employ a cantilever actuator to improve ink displacement and prevent backflow of ink. Further, the inkjet printhead according to the present invention may reduce the size of the ink chamber needed to eject ink droplets and improve the uniformity of the volume ejected. In addition, the inkjet printhead according to the present invention may have a reduced distance between adjacent nozzles, thus having a greater number of CPI as compared to a conventional inkjet printhead. The inkjet printhead according to the present invention may also be formed as a page-wide inkjet printhead, allowing higher printing speeds to be more easily realized, and also may be easily manufactured by stacking a plurality of plates or sheets, e.g., stainless steel sheets.

Figure 3:
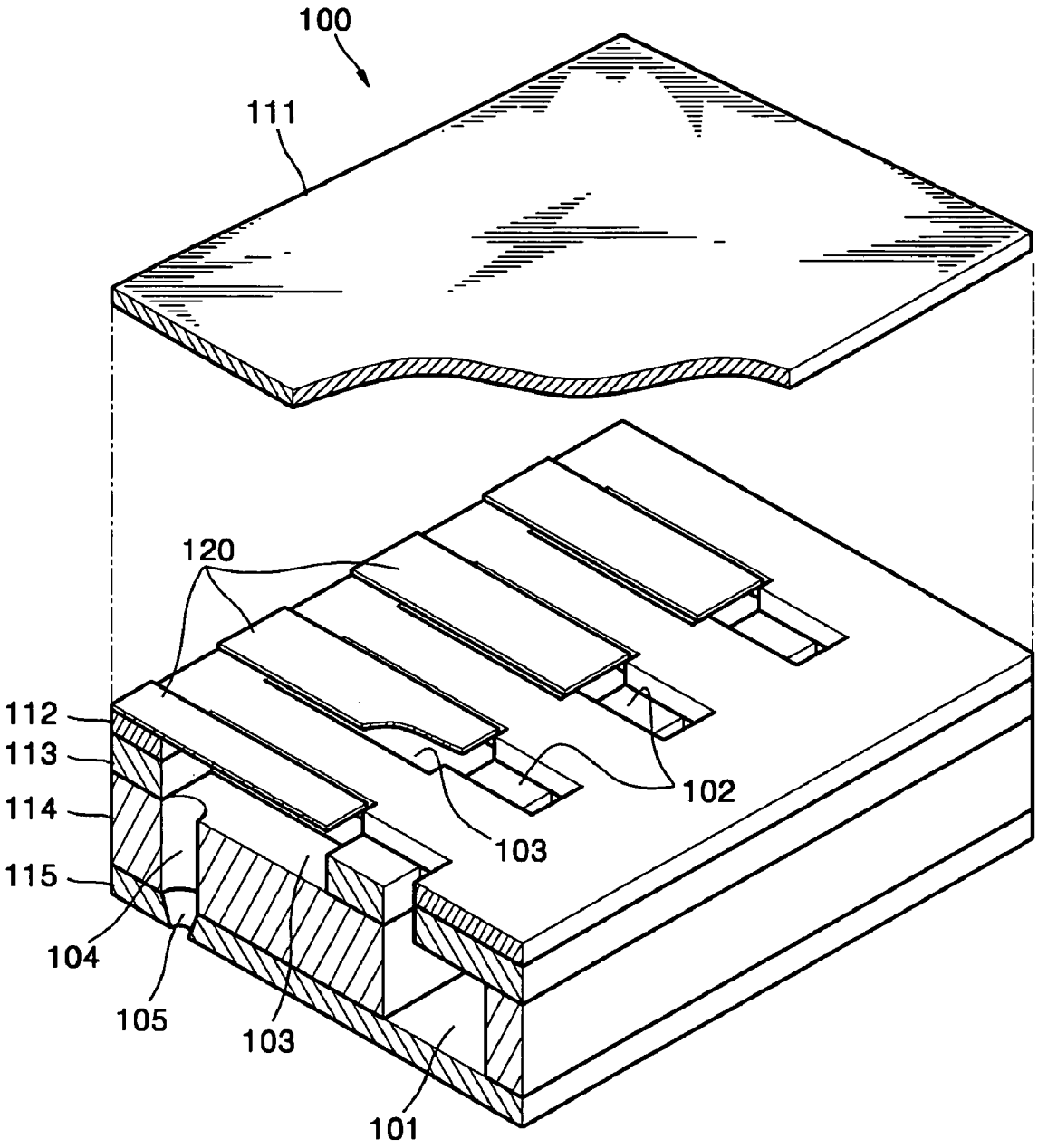
FIG. 3 illustrates a partial exploded perspective view of an inkjet printhead having a cantilever actuator according to an embodiment of the present invention.
Figure 4:
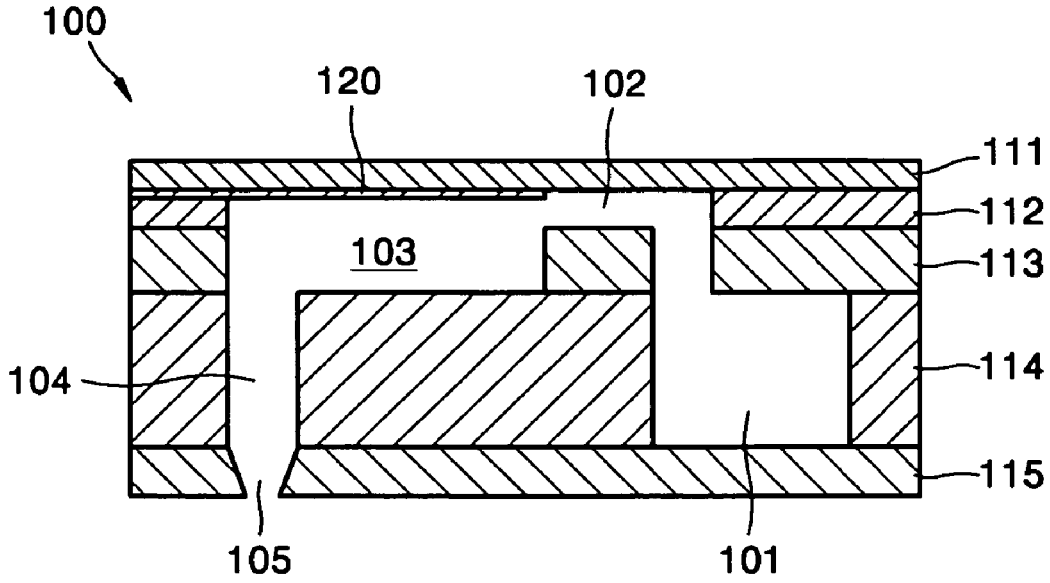
FIG. 4 illustrates a vertical sectional view of the inkjet printhead illustrated in FIG. 3.

FIG. 3 illustrates a partial exploded perspective view of an inkjet printhead having a cantilever actuator according to an embodiment of the present invention, and FIG. 4 illustrates a vertical sectional view of the inkjet printhead illustrated in FIG. 3. Referring to FIGS. 3 and 4, an inkjet printhead 100 may include one or more ink channels including ink chambers 103, to contain ink to be ejected, and corresponding cantilever actuators 120, to provide a driving force to the plurality of ink chambers 103 for ink ejection. The ink channels may also include a manifold 101 to supply ink to the ink chambers 103, a plurality of restrictors 102, to supply ink from the manifold 101 to the plurality of ink chambers 103, and a plurality of nozzles 105, through which ink is ejected from the ink chambers 103. A plurality of dampers 104 may be disposed between the ink chambers 103 and the nozzles 105, to damp a sharp pressure change e.g., one resulting from driving the cantilever actuator 120.

The ink chambers 103, the manifold 101, the restrictors 102, the nozzles 105 and the dampers 104 constituting the ink channels may be formed of a plurality of stacked channel plates 111-115. That is, the plurality of channel plates 111-115 may include a first channel plate 111, a second channel plate 112, a third channel plate 113, a fourth channel plate 114 and a fifth channel plate 115 as shown in FIGS. 3 and 4.

In detail, upper portions of the ink chambers 103 and restrictors 102 may pass through the second channel plate 112. The ink chambers 103 may be arranged in parallel with one another, and each may have a long rectangular shape that is oriented with the long dimension parallel to a direction of ink flow. Each restrictor 102 may be connected to one end of a corresponding ink chamber 103.

The first channel plate 111 may be attached to a top surface of the second channel plate 112 to cover the ink chambers 103 and the restrictors 102. That is, the first channel plate 111 may form an upper wall, or ceiling, of the ink chambers 103.

The third channel plate 113 may be attached to a bottom surface of the second channel plate 112, such that lower portions of the ink chambers 103 pass through the third channel plate 113.

The fourth channel plate 114 may be attached to a bottom surface of the third channel plate 113, and the manifold 101 may be formed in the fourth channel plate 114. The dampers 104 connecting the ink chambers 103 and the nozzles 105 may pass through the fourth channel plate 114. Each damper 104 may be positioned at an end of the corresponding ink chamber 103 at an opposite end from the restrictor 102.

The fifth channel plate 115, having nozzles 105 passing therethrough, may be attached to a bottom surface of the fourth channel plate 114. The nozzles 105 may have a tapered shape with a decreasing cross-section toward an outlet.

Each of the five channel plates 111-115 may be, e.g., a silicon substrate, in which case ink channels may be formed in various ways by processing the silicon substrate using semiconductor manufacturing processes. Each of the five channel plates 111-115 may also be a metal sheet, e.g., a stainless steel sheet, having ink corrosion-resistance. In this case, the ink channels may be formed in various ways by etching, punching, laser processing, etc. Stainless steel sheets may be attached to one another by, e.g., brazing. Of course, the present invention is not limited to silicon substrates or metal sheets, and each of the five channel plates 111-115 may be formed of any other suitable substrate. Further, the ink channels described above as formed on the five channel plates 111-115 are simply examples, and the inkjet printhead 100 may have ink channels of various structures, may be formed of more or less than five channel plates, etc.

In an embodiment of the present invention, the cantilever actuator 120 may be provided in each ink chamber 103 to apply pressure for ink ejection to ink filled in the ink chamber 103. In detail, the cantilever actuator 120 may have one end fixed to a side wall of the ink chamber 103 and another end freely disposed in the ink chamber 103, so as to have one or more degrees of freedom through which it may be deflected. Through deflection of the free end of the cantilever actuator 120, pressure for ink ejection may be applied to ink filled in the ink chamber 103.

Since the cantilever actuator 120 may be fixed at one end and freely deflected at the other end, the displacement of the free end of the cantilever actuator 120 may be greater than that of a conventional piezoelectric actuator, which has no free, i.e., deflectable, ends. Accordingly, the size, i.e., area, of the ink chamber 103 needed to eject ink droplets of uniform volume may be reduced, and thus a distance between adjacent nozzles 105 may be reduced.

Figure 5:
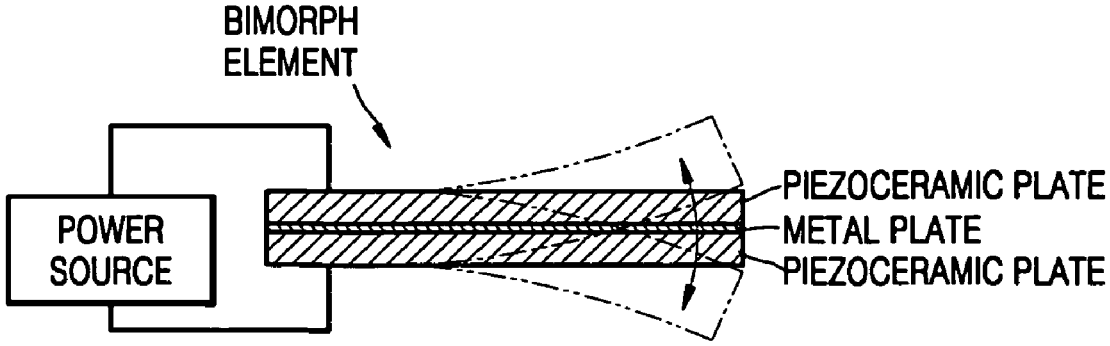
FIG. 5 illustrates a schematic view for explaining a piezobimorph element as an example of the cantilever actuator shown in FIG. 4.

FIG. 5 illustrates a schematic view for explaining a piezobimorph element as an example of the cantilever actuator shown in FIG. 4. Referring to FIG. 5, the cantilever actuator 120 may be, e.g., a bimorph element. The bimorph element may include a metal plate sandwiched between piezoceramic plates that are polarized in opposite directions. When voltage is applied to such a piezo-bimorph element, stresses applied to the piezoceramic plates sandwiching the intermediate metal plate are opposite in direction, such that the bimorph element may be deflected in two directions, e.g., downward and upward. It will be appreciated that the direction of deflection may be controlled by the polarity of the voltage applied to the bimorph element.

Referring to FIGS. 3 and 4, the fixed end of the cantilever actuator 120 may be fixed between the second channel plate 112, on which the plurality of ink chambers 103 and the plurality of restrictors 102 are formed, and the first channel plate 111, which covers the plurality of ink chambers 103 and the plurality of restrictors 102. In an embodiment, the cantilever actuator 120 may contact the ceiling, i.e., the upper wall, of the ink chamber 103, which may be a bottom surface of the first channel plate 111. In this embodiment, the freedom of the cantilever actuator 120 may be limited by the ceiling of the ink chamber 103. That is, the free end of the cantilever actuator 120 may be deflected only in one direction, e.g., downward, and not in the other, e.g., upward, direction.

The cantilever actuator 120 may have a shape corresponding to the shape of the ink chamber 103, e.g., a rectangular shape, and may be configured to apply pressure over a wide area of ink inside the ink chamber 103. To prevent an interference with a sidewall of the ink chamber 103 during the deflection of the cantilever actuator 120, a width of the cantilever actuator 120 may be slightly less than a corresponding width of the ink chamber 103. Similarly, a length of the cantilevered portion of the cantilever actuator 120 may be slightly less than a length of the ink chamber 103.

The cantilever actuator 120 may act to eject ink from the ink chamber 103, via the nozzle 105, through deflection of the free end thereof, as described above. Additionally, the free end of the cantilever actuator 120 may be disposed adjacent to an outlet of the restrictor 102, such that the cantilever actuator 120 may eject ink and also prevent backflow of ink from the ink chamber 103 to the restrictor 102. Note that, where the backflow of ink is prevented by the cantilever actuator 120, the size of the ink chamber 103 needed to eject ink droplets of uniform volume may be further reduced.

Figure 6A:
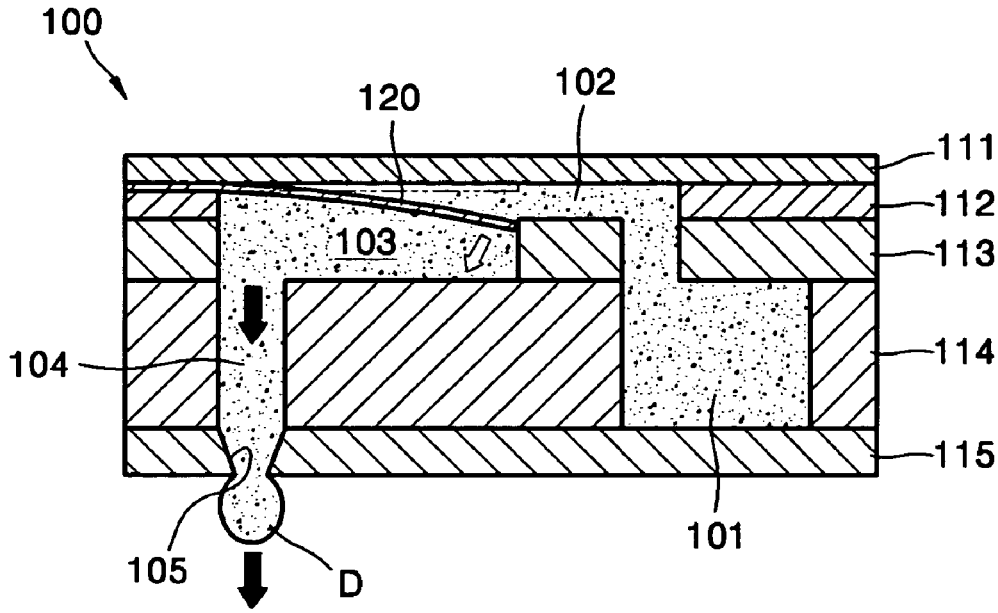
FIGS. 6A and 6B illustrate vertical sectional views for explaining the operation of the cantilever actuator in the inkjet printhead shown in FIGS. 3 and 4.

An operation of the cantilever actuator in the inkjet printhead illustrated in FIG. 4 will now be explained with reference to FIGS. 6A and 6B. Referring to FIG. 6A, if voltage is applied to drive the cantilever actuator 120 and the free end of the cantilever actuator 120 is deflected downward to eject ink, pressure is applied to ink filled in the ink chamber 103. Accordingly, ink is outwardly ejected through the damper 104 and the nozzle 105. Further, the downwardly-deflected end of the cantilever actuator 120, i.e., the free end, may block an ink flow path to prevent backflow of ink, e.g., block the passage between the ink chamber 103 and the restrictor 102 to prevent backflow of ink from the ink chamber 103 to the restrictor 102.

Figure 6B:
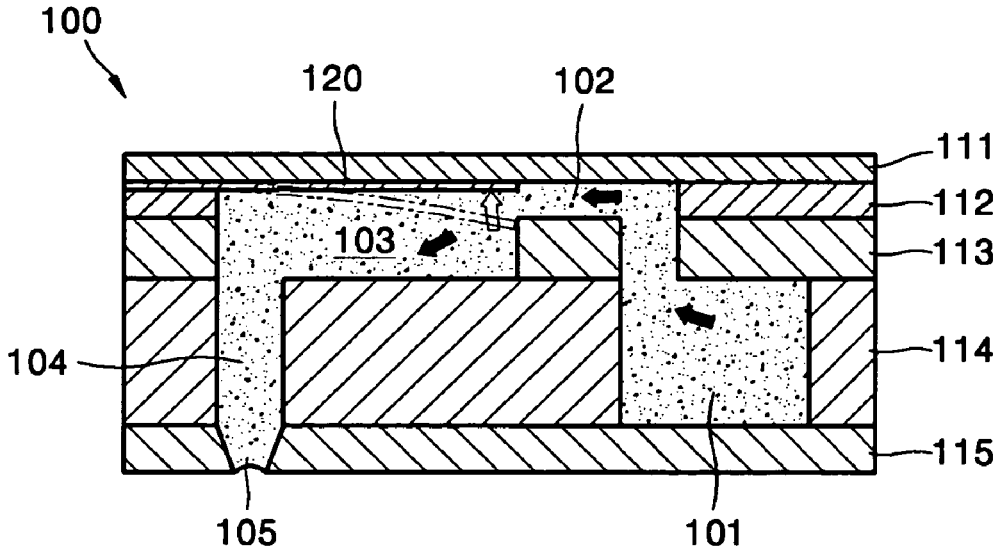

After ink ejection occurs, if the voltage applied to the cantilever actuator 120 is cut off, as illustrated in FIG. 6B, the free end of the cantilever actuator 120 returns to its original state. Accordingly, the ink chamber 103 and the restrictor 102 again communicate with each other, and ink stored in the manifold 101 may be introduced into the ink chamber 103 through the restrictor 102. Of course, it will be appreciated that, where a bimorph element is used for the cantilever actuator 120, the voltage applied to drive the cantilever actuator 120 may be changed to drive it in the opposite direction, e.g., an upward direction to contact the first channel plate 111.

As described above, the inkjet printhead 100 according to the present embodiment may eject ink and also prevent backflow of ink by virtue of a unidirectional deflection of the cantilever actuator 120, e.g., by a deflection below its resting position.

Figure 7:
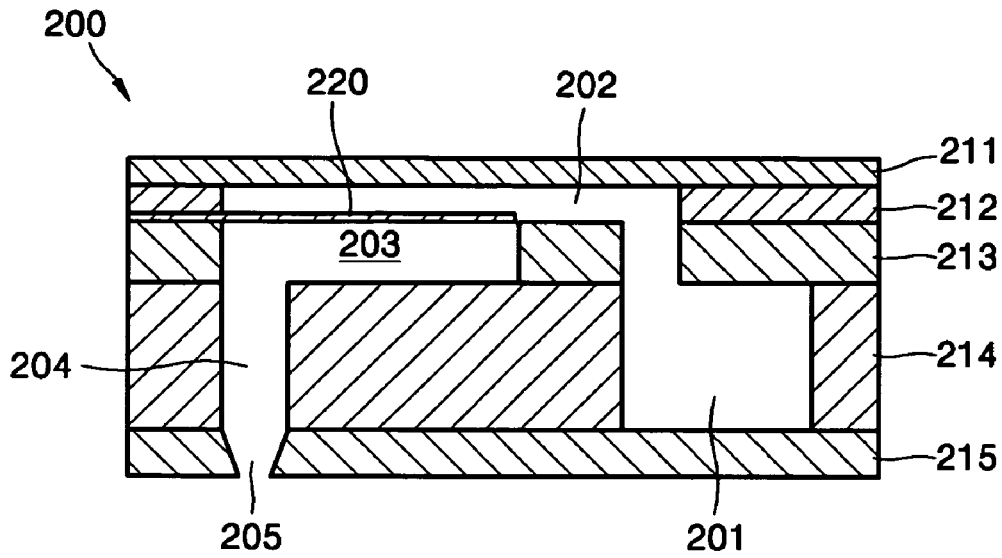
FIG. 7 illustrates a vertical sectional view of an inkjet printhead according to another embodiment of the present invention.
Figure 8A:
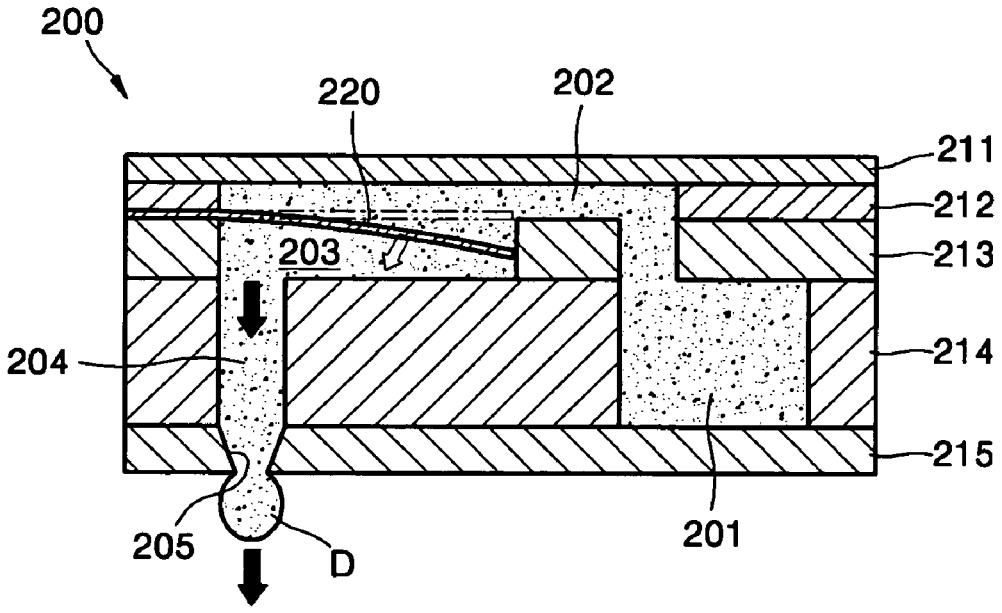
FIGS. 8A and 8B illustrate vertical sectional views for explaining the operation of a cantilever actuator in the inkjet printhead shown in FIG. 7.
Figure 8B:
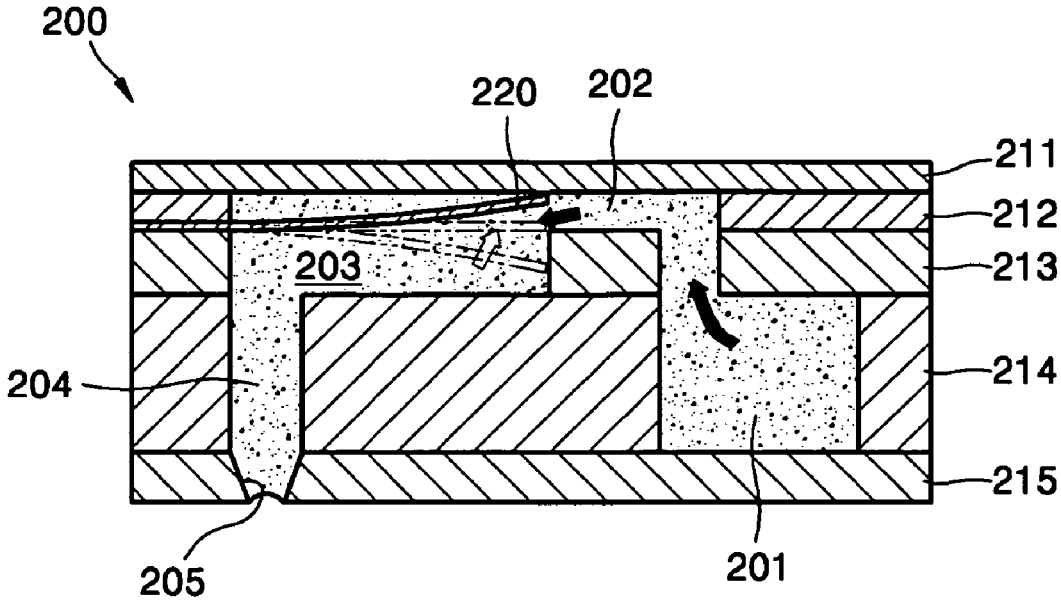

FIG. 7 illustrates a vertical sectional view of an inkjet printhead according to another embodiment of the present invention, and FIGS. 8A and 8B illustrate vertical sectional views for explaining the operation of a cantilever actuator in the inkjet printhead shown in FIG. 7. According to this embodiment, an inkjet printhead 200 illustrated in FIG. 7 may be substantially similar in construction to the inkjet printhead 100 illustrated in FIG. 4, except for the relative position of the cantilever actuator 220. Accordingly, in order to avoid repetition, the inkjet printhead 200 will be explained with particular reference to the differences from the inkjet printhead 100 and omitting repetition of detailed descriptions of substantially similar elements.

Referring to FIGS. 7, 8A and 8B, the inkjet printhead 200 may include a manifold 201, a plurality of restrictors 202, a plurality of ink chambers 203, a plurality of dampers 204 and a plurality of nozzles 205, which constitute ink channels, formed on stacked first through fifth channel plates 211-215.

In the inkjet printhead 200, one end of the cantilever actuator 220 may be fixed between the second channel plate 212 and the third channel plate 213. The cantilever actuator 220 may be a piezo-bimorph element as shown in FIG. 5. As illustrated, the cantilever actuator 220 may be spaced a predetermined distance from the ceiling, i.e., the upper wall, of the ink chamber 203, such that the free end of the cantilever actuator 220 may be deflected in two directions, e.g., the cantilever actuator 220 may be driven to deflect the free end both above, and below, a resting position.

An operation of the cantilever actuator 220 will now be explained. Referring to FIG. 8A, if a voltage is applied to the cantilever actuator 220 and the free end of the cantilever actuator 220 is deflected in one direction, e.g., downward, for the purpose of ink ejection, pressure is applied to ink filled in the ink chamber 203, and accordingly, the ink is outwardly ejected through the damper 204 and the nozzle 205. Further, the downwardly deflected free end of the cantilever actuator 220 may also partially or completely block an ink flow path between the ink chamber 203 and the restrictor 202. Accordingly, driving the cantilever actuator 220 in this manner may eject ink and prevent backflow of ink from the ink chamber 203 to the restrictor 202.

Referring to FIG. 8B, after ink ejection occurs, if the voltage applied to the cantilever actuator 220 is changed, the free end of the cantilever actuator 220 may be deflected in the opposite direction, e.g., upward. Accordingly, the ink flow path between the ink chamber 203 and restrictor 202 is no longer blocked, such that the ink chamber 203 and the restrictor 202 again communicate with each other, and ink stored in the manifold 201 may flow into the ink chamber 203 through the restrictor 202.

As described above, the inkjet printhead 200 may eject ink and may also prevent backflow of ink by virtue of the bidirectional deflection of the cantilever actuator 220. Referring to FIGS. 7-8B, the cantilever actuator 220 is illustrated as being disposed relative to the restrictor 202 such that the free end, when not deflected, is disposed to be approximately even with a lower wall of the restrictor 202. However, it will be appreciated that the present invention is not limited to this configuration, and that the free end of the cantilever actuator 220 may have a resting position that is not aligned with the lower wall of the restrictor 202, e.g., it may rest above or below the level of the lower wall of the restrictor 202. It will further be appreciated that the disposition of the cantilever actuator 220 with respect to the restrictor 202 and the ink channel generally is relative to a number of factors including, e.g., the distance through which the free end of the cantilever actuator 220 may be deflected, the size of the restrictor 202, the thickness of the second channel plate 212, etc. Accordingly, the present invention is not limited to the specific examples detailed herein.

Figure 9:
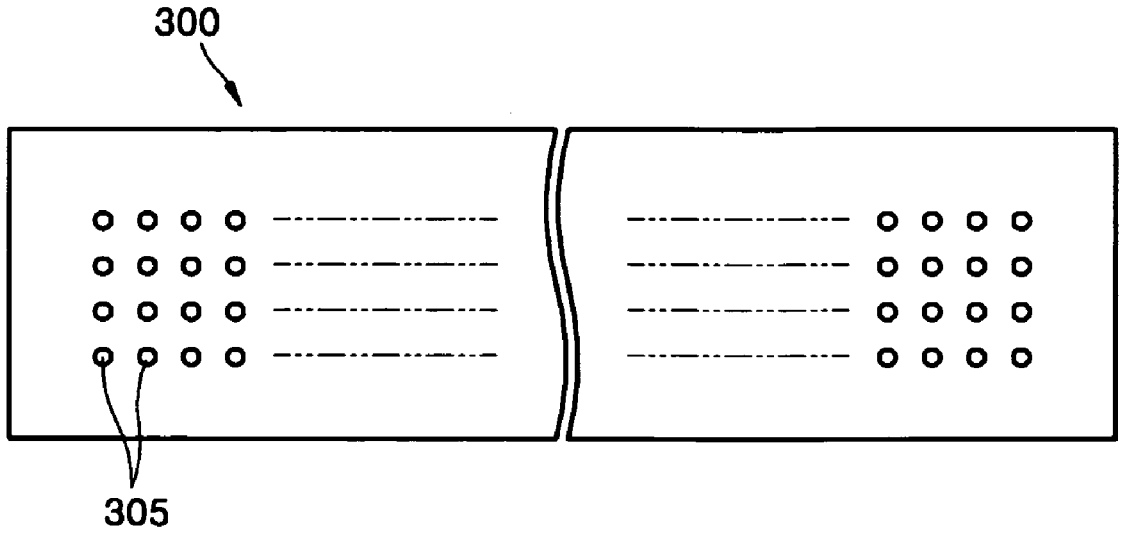
FIG. 9 illustrates a plan view of a nozzle arrangement in a page-wide inkjet printhead according to the present invention.

FIG. 9 illustrates a plan view of a nozzle arrangement in a page-wide inkjet printhead according to the present invention. Referring to FIG. 9, the present invention is applied to a page-wide inkjet printhead 300. The page-wide inkjet printhead 300 may have a length corresponding to a width of a print medium, such as a sheet of paper upon which an image is to be printed. Here, the width of the printing sheet means a dimension measured in a direction orthogonal to a feed direction of the sheet. The inkjet printhead 300 may include a plurality of nozzles 305 arrayed in a longitudinal direction of the printhead 300.

Where the page-wide inkjet printhead 300 is long, it may be formed of a plurality of channel plates, each of which may be, e.g. a stainless steel sheet, in order to maintain the strength of the page-wide inkjet printhead 300. That is, the page-wide inkjet printhead 300 may be manufactured by, e.g., stacking a plurality of stainless steel sheets. In the page-wide inkjet printhead 300, the size of ink chambers (not shown) corresponding to the nozzles 305 may be suitably reduced to improve the number of CPI without an undue reduction in the ability of the page-wide inkjet printhead 300 to eject ink droplets of uniform volume, since the page-wide inkjet printhead 300 employs a cantilever actuator, which may have a large displacement while reducing or preventing the backflow of ink. Therefore, since the number of CPI of the inkjet printhead 300 may be increased, e.g., to be close to (or equal to) the number of DPI of an image, reciprocation in a width direction of the printing sheet of paper is minimized (or not required), thereby enabling higher printing speeds.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An inkjet printhead, comprising:

a manifold coupled to a plurality of ink channels, each ink channel including a restrictor, an ink chamber and a nozzle, wherein each ink chamber includes a cantilever actuator having a fixed end and a deflectable end, the cantilever actuator being disposed in the ink chamber and extending parallel to an upper surface of the ink chamber toward the restrictor, the upper surface of the ink chamber facing away from the nozzle, wherein the deflectable end of the cantilever actuator is configured to deflect away from the upper surface of the ink chamber to eject ink via the nozzle, and wherein upon deflection of the deflectable end of the cantilever actuator away from the upper surface of the ink chamber, the deflectable end is configured to be adjacent to a portion of a channel plate defining a sidewall of the ink chamber to restrict a backflow of ink from the ink chamber to the restrictor.

2. The inkjet printhead as claimed in claim 1, wherein the cantilever actuator is a piezoelectric actuator that moves the deflectable end in a first direction with respect to the fixed end upon application of a voltage having a first polarity.

3. The inkjet printhead as claimed in claim 2, wherein the cantilever actuator is a bimorph piezoelectric actuator that moves the deflectable end in a first direction with respect to the fixed end upon application of a voltage having a first polarity and moves the deflectable end in a second direction, opposite the first direction, upon application of a second voltage having a polarity opposite the first polarity.

4. The inkjet printhead as claimed in claim 1, wherein the cantilever actuator has an inactive state and a first active state, the cantilever actuator is disposed to regulate a cross-section of an ink flow path between the ink chamber and the restrictor, the ink flow path has a first cross-section when the cantilever actuator is in the inactive state, and the ink flow path has a second cross-section that is smaller than the first cross-section when the cantilever actuator is in the first active state.

5. The inkjet printhead as claimed in claim 4, wherein the cantilever actuator further has a second active state, and the ink flow path has a third cross-section that is larger than the first cross-section when the cantilever actuator is in the second active state.

6. The inkjet printhead as claimed in claim 1, wherein the fixed end of the cantilever actuator is inserted between two channel plates, one of the two channel plates has the ink chamber and the restrictor formed therein, and another of the two channel plates forms a ceiling wall of the ink chamber and the restrictor.

7. The inkjet printhead as claimed in claim 6, wherein the cantilever actuator is disposed adjacent to the ceiling wall of the ink chamber, such that the deflectable end of the cantilever actuator can be deflected, relative to the fixed end, only in a direction that is away from the ceiling wall.

8. The inkjet printhead as claimed in claim 6, wherein:

the cantilever actuator has an inactive state and an active state, the restrictor has a thickness corresponding to a thickness of the one channel plate, the deflectable end deflects a distance, relative to a location thereof in the inactive state, upon application of a voltage in the active state, and the distance is greater than the thickness of the restrictor.

9. The inkjet printhead as claimed in claim 1, wherein the fixed end of the cantilever actuator is inserted between two channel plates, one of the two channel plates has the ink chamber formed therein, and another of the two channel plates has the restrictor formed therein.

10. The inkjet printhead as claimed in claim 9, wherein the cantilever actuator is spaced a predetermined distance from an upper wall of the ink chamber, such that the deflectable end of the cantilever actuator can move in a first direction with respect to the fixed end upon application of a voltage having a first polarity and move in a second direction, opposite the first direction, upon application of a second voltage having a polarity opposite the first polarity.

11. The inkjet printhead as claimed in claim 10, wherein the ink chamber is formed in the one channel plate such that the ink chamber has a dimension corresponding to a thickness of the one channel plate, and the deflectable end moves into the ink chamber when it moves in the first direction.

12. The inkjet printhead as claimed in claim 11, wherein the deflectable end moves away from the restrictor when it moves in the first direction.

13. The inkjet printhead as claimed in claim 9, wherein the cantilever actuator is a bimorph element.

14. The inkjet printhead as claimed in claim 13, wherein the bimorph element includes a metal plate sandwiched between piezoceramic plates that are polarized in opposite directions.

15. The inkjet printhead as claimed in claim 1, wherein the cantilever actuator has a shape corresponding to the shape of the ink chamber.

16. The inkjet printhead as claimed in claim 15, wherein a width of the cantilever actuator is less than a corresponding width of the ink chamber.

17. The inkjet printhead as claimed in claim 16, wherein a length of a cantilevered portion of the cantilever actuator is less than a corresponding length of the ink chamber.

18. The inkjet printhead as claimed in claim 1, wherein the inkjet printhead has a length corresponding to a width of a print medium and further comprises a plurality of nozzles arrayed in a longitudinal direction of the inkjet printhead.

19. An inkjet printhead comprising:

a manifold coupled to a plurality of ink channels;

each ink channel including a restrictor, an ink chamber and a nozzle;

each ink chamber having sidewalls and including a first length and a first width perpendicular to each other;

a cantilever actuator in each ink chamber, the cantilever actuator having a fixed end and a deflectable end, the deflectable end being configured to deflect to eject ink via the nozzle; and the cantilever actuator having a shape corresponding to the shape of the ink chamber, a second width of the cantilever actuator being smaller than the first width of the ink chamber by a first amount, and a second length of a cantilevered portion of the cantilever actuator being smaller than the first length of the ink chamber by a second amount, the first and second amounts being substantially small and sufficient only to prevent interference between the cantilevered portion and corresponding sidewalls of the ink chamber during deflection of the cantilevered portion.

20. The inkjet printhead as claimed in claim 19, wherein the cantilever actuator is disposed relative to the restrictor such that the deflectable end can restrict a backflow of ink from the ink chamber to the restrictor.

21. The inkjet printhead as claimed in claim 20, wherein the cantilever actuator has an inactive state and an active state, the cantilever actuator is disposed to regulate a cross-section of an ink flow path between the ink chamber and the restrictor, the ink flow path has a first cross-section when the cantilever actuator is in the inactive state, and the ink flow path has a second cross-section that is smaller than the first cross-section when the cantilever actuator is in the active state.

* * * * *